US006908359B2

(12) United States Patent
Orlowski

(10) Patent No.: US 6,908,359 B2
(45) Date of Patent: Jun. 21, 2005

(54) WATER SKIPPING TOY

(75) Inventor: Boguslaw Orlowski, Oceanside, CA (US)

(73) Assignee: Chapman-Walters Intercoastal Corp., Laguna Niguel, CA (US)

( * ) Notice: Subject to any disclaimer, the term of this patent is extended or adjusted under 35 U.S.C. 154(b) by 0 days.

(21) Appl. No.: 10/305,161

(22) Filed: Nov. 27, 2002

(65) Prior Publication Data

US 2004/0102131 A1 May 27, 2004

(51) Int. Cl.[7] ..... A63H 27/00
(52) U.S. Cl. ..... 446/46; 473/588
(58) Field of Search ..... 446/34, 46, 236, 446/486, 250; 473/588, 589

(56) References Cited

U.S. PATENT DOCUMENTS 3,544,113 A * 12/1970 Hand ..... 473/588
4,078,801 A * 3/1978 White, Sr. ..... 473/588
4,351,129 A * 9/1982 Kerkenbush et al. ..... 446/46
5,014,990 A * 5/1991 Kaser et al. ..... 473/588
5,540,610 A * 7/1996 Sneddon ..... 446/46
5,679,082 A * 10/1997 Hincke ..... 473/588

* cited by examiner

*Primary Examiner*—Bena B. Miller
(74) *Attorney, Agent, or Firm*—Leonard Tachner

(57) ABSTRACT

A water skipping toy which has the desired characteristics of a few, simple, low cost parts that are easily produced using injection molding and minimal assembly time. The preferred embodiment comprises two substantially identical convex plastic discs each having an annular flange recessed from the outer perimeter of the disc. The flange of one of the discs is taller and has a slightly larger diameter than the flange of the other disc so that the two flanges are radially juxtaposed when the two discs are joined together. The discs may be secured together by the press fit engagement of the two annular flanges or the flanges may be glued to each other by a common adhesive along contiguous radial surfaces of the flanges. The discs create an air pocket between them which makes the toy lighter and buoyant. The third component of the preferred embodiment comprises a relatively soft rubber ring which encircles the outer radial edges of the discs to provide a safety barrier.

10 Claims, 2 Drawing Sheets

WATER SKIPPING TOY

BACKGROUND OF THE INVENTION

1. Field of the Invention

The preseent invention relates generally to a toy configured for being tossed along the surface of a body of water such as a swimming pool or the ocean. The invention relates more specifically to a water skipping toy that is safe to use, inexpensive to produce and readily manufactured from only three simple parts.

2. Background Art

There are a surprising number of prior art U.S. patents which relate to water skipping toys. These patents are variously entitled "Saucer-Shaped Water Skipping Devices" (U.S. Pat. No. 5,679,082); "Skimming Disk" (U.S. Pat. No. 6,383,052); "Hydrodynamic Throwing Device" (U.S. Pat. No. 6,241,570); and "Hydroplaning Disk" (U.S. Pat. No. 5,836,840). All of these prior toy designs are generally similar. They are disk or saucer-shaped devices designed to be tossed or thrown generally parallel to the surface of water against which they tend to bounce or skip one or more times until they come to a floating rest on the water surface. Some of these prior art water skipping toys are relatively exotic with special gripping perimeters and materials to optimize their aerodynamic and hydrodynamic performance. However, such devices are more costly to manufacture thereby making them too expensive to be commercially successful as a relatively simple toy concept; i.e., throw it and see it skip along the water surface. Even the more simple prior art skipping toys are not configured for modern low cost manufacturing. They are typically not configured for injection molding or easy assembly with minimal hands-on labor. They employ too many parts and too many specially shaped components which require more expensive tooling and assembly.

Accordingly, it would be highly desirable to have a water skipping toy which had the advantages of being simple in design and of few parts that are easily manufactured and assemblied so that the toy is low cost at the retail level and thus more accessible to the marketplace.

SUMMARY OF THE INVENTION

The present invention in its preferred embodiment, comprises a water skipping toy which has the desired characteristics of a few, simple, low cost parts that are easily produced using injection molding and minimal assembly time. The resulting toy is easily accessible to the marketplace which promotes high volume sales of an inexpensive, safe water toy.

The preferred embodiment comprises two substantially identical convex plastic discs each having an annular flange recessed from the outer perimeter of the disc. The flange of one of the discs is taller and has a slightly larger diameter than the flange of the other disc so that the two flanges are radially juxtaposed when the two discs are joined together. The discs may be secured together by the press fit engagement of the two annular flanges or the flanges may be glued to each other by a common adhesive along contiguous radial surfaces of the flanges. When so joined together, the discs form an internal air pocket which makes the toy lighter than solid versions of the prior art and also makes the toy sufficiently buoyant to float on the water surface. The third component of the preferred embodiment comprises a relatively soft rubber ring. The ring has a larger semi-circular cross-section along its outer perimeter to provide a safety bumper to protect children who may come in contact with a thrown toy. The ring has a smaller trapezoidal cross-section along its inner perimeter which is designed to be received in an annular recess or groove formed between the joined discs outside the mating flanges. Thus, the ring is configured to be secured around the perimeter of the discs with the larger portion thereof extending beyond the discs' outer edges for protection of the players.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

BRIEF DESCRIPTION OF A PREFERRED EMBODIMENT

Figure 1:
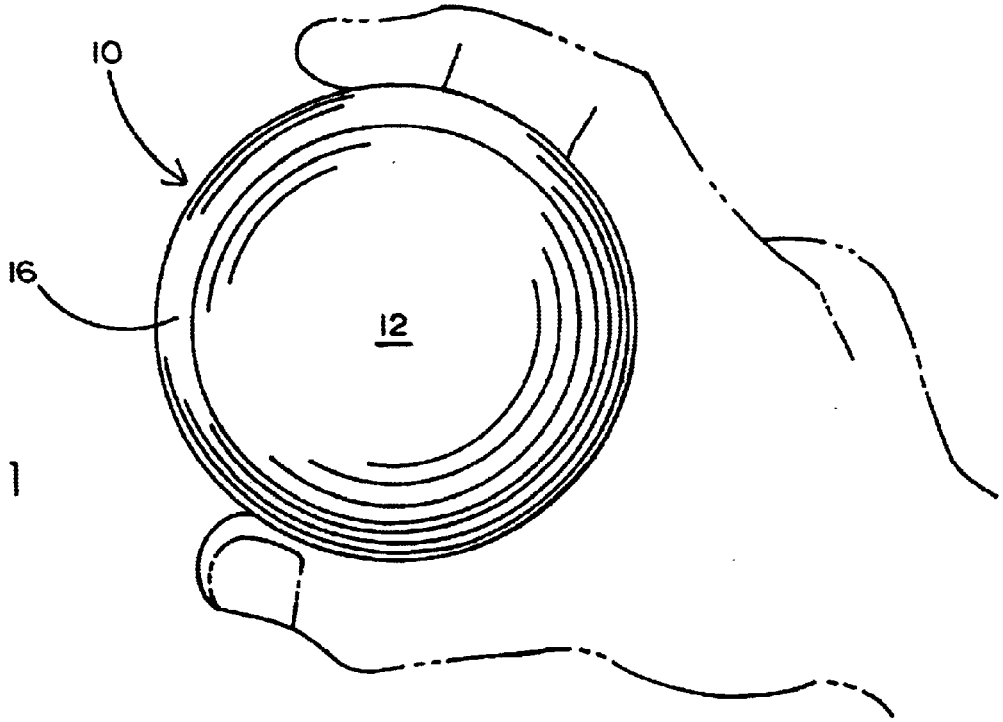
FIG. 1 is a top view of the preferred embodiment of the invention.
Figure 2:
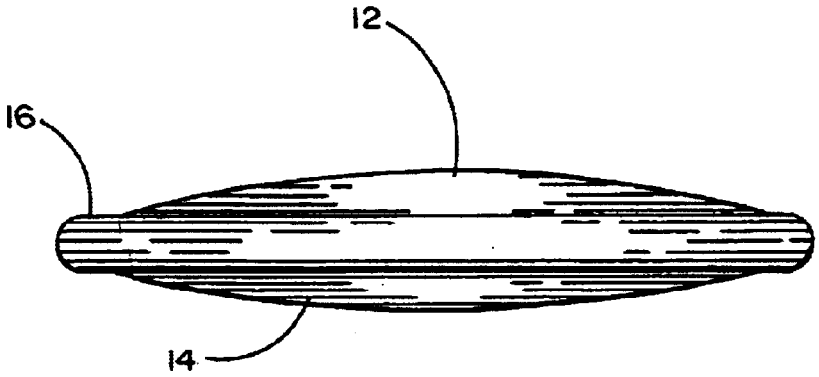
FIG. 2 is an edge view of the preferred embodiment.

Referring to the accompanying drawings, it will be seen that a preferred embodiment of a water skipping toy 10 of the present invention comprises a first convex disc 12, a second convex disc 14 and a flexible ring 16. First convex disc 12 has a radial flange 18 extending parallel to the axis of the disc from the inner concave surface 13 thereof. Second convex disc 14 has a radial flange 20 extending parallel to the axis of the disc from the inner concave surface 15 thereof. Flange 20 is slightly higher and slightly bigger in diameter than flange 18 as seen best in FIG. 3. The two discs form an internal air pocket 29.

Figure 3:
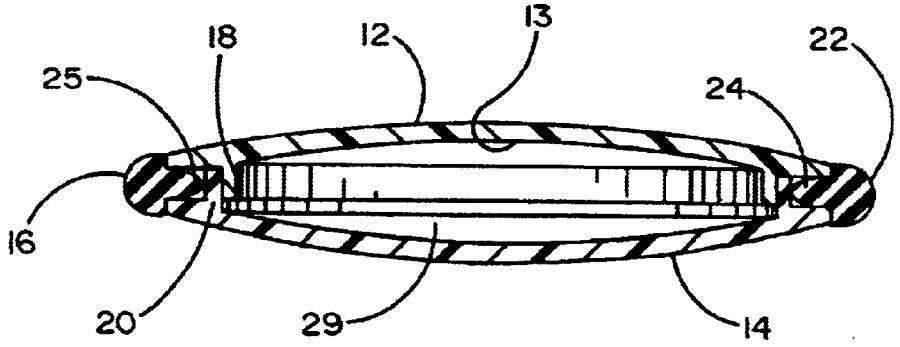
FIG. 3 is a cross-sectional edge view.
Figure 4:
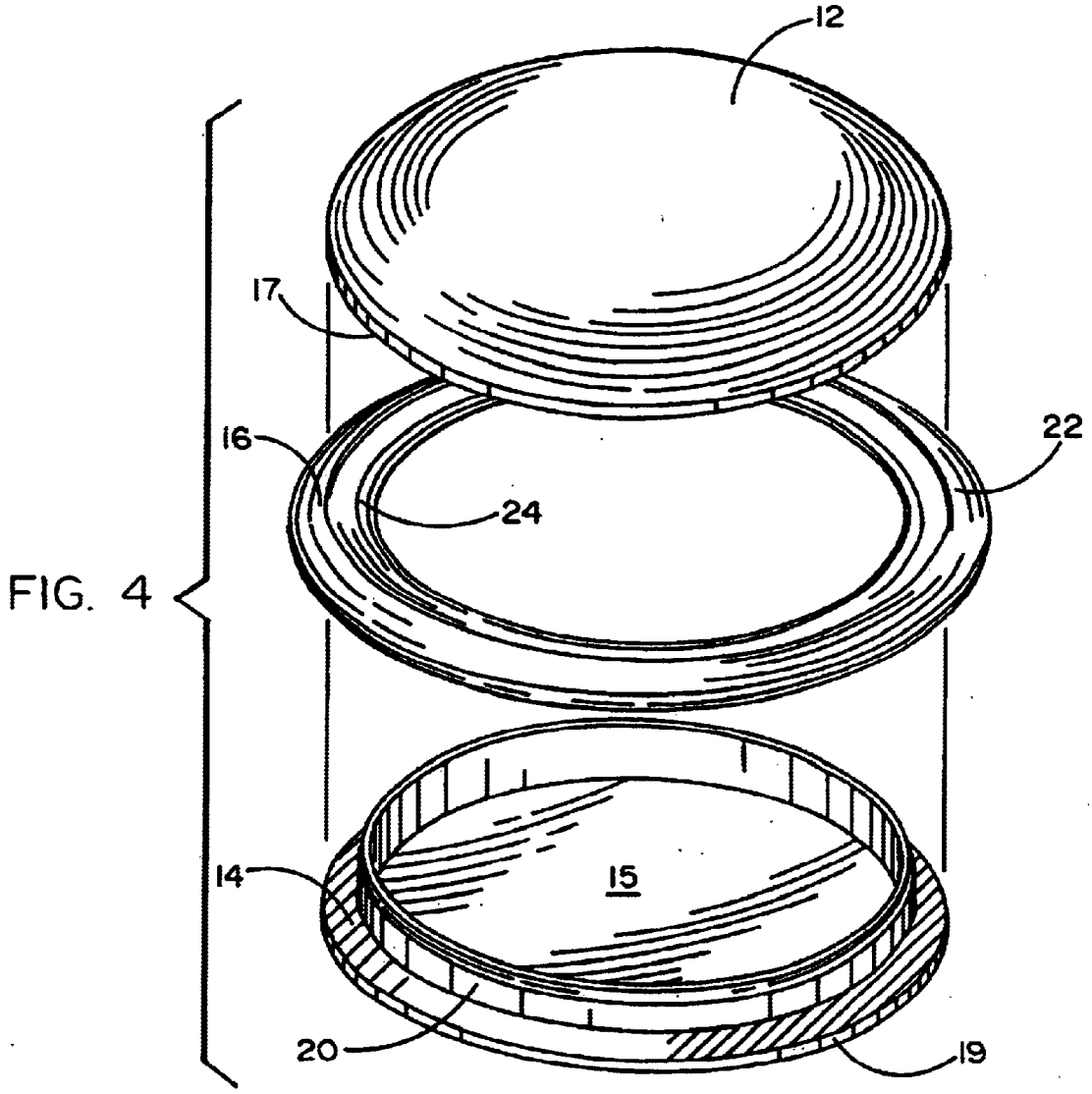
FIG. 4 is an exploded view thereof.

As also seen best in FIG. 3, each flange is recessed from the respective outer peripheral edges 17 and 19 of the discs 12 and 14 whereby a ring receiving annulus 25 is formed when the discs are joined together. Ring 16 has an inner portion 24 and an outer portion 22, the latter overlapping edges 17 and 19 for safety of the players. Inner portion 24 is received in the ring receiving annulus 25 and is secured therein by the slight expansion of the overall diameter of ring 16 to engage the discs 12 and 14.

In the preferred method of manufacture of the illustrated embodiment, the discs 12 and 14 are injection molded rigid plastic components. Ring 16 is a molded rubber or rubber-like component of selected flexibility and softness to provide easy assembly and player safety.

Having thus disclosed an exemplary embodiment of the present invention, it will now be understood that various modifications and additions may be made thereto. By way of example, while the disclosed embodiment is shown to be of a size suitable for grasping between the thumb and forefinger of a player, other sizes, both larger and smaller, may be readily provided. Moreover, the precise shape of each disc may be readily altered without departing from the salient features of the invention. Accordingly, the scope hereof is limited only by the appended claims and their equivalents.

I claim:

1. A buoyant toy for being thrown along the surface of a body of water and skipping along the surface; the toy comprising:

a pair of outwardly convex discs having respective outer perimeters of substantially equal diameters and having opposed annular flanges of unequal diameter extending toward each other in-board of said disc perimeters in substantially contiguous relation forming an internal empty air pocket between said discs and forming a ring receiving annulus between said perimeters of the discs and outside said air pocket; and a flexible ring expansively installed in said annulus and extending radially beyond said disc perimeters.

2. The buoyant toy recited in claim 1 wherein said discs are adhesively joined along said contiguous flanges to form a unitary structure.

3. The buoyant toy recited in claim 1 wherein one of said flanges is higher than the other of said flanges.

4. The buoyant toy recited in claim 1 wherein said ring comprises an outer semi-circular cross-section and an inner trapezoidal cross-section.

5. The buoyant toy recited in claim 1 wherein said discs are sized to fit between the thumb and forefinger of a user.

6. A disc-shaped buoyant water toy comprising:

a pair of outwardly convex opposed disc halves having opposed outer perimeters and being joined together co-axially to form an internal empty air pocket therebetween and forming an annular recess along a joint perimeter of said disc halves outside of said air pocket and between said perimeters; and a rubber-like ring expansively encircling said disc halves and at least partially received in said annular recess in compressive engagement with said perimeters.

7. The buoyant toy recited in claim 6 wherein each said disc comprises an integral annular flange extending toward the other disc half.

8. The buoyant toy recited in claim 7 wherein said respective flanges are substantially contiguous along respective radial surfaces.

9. The buoyant toy recited in claim 8 wherein said respective radial surfaces are adhesively joined to form a unitary,structure.

10. The buoyant toy recited in claim 6 wherein said ring comprises an outer semi-circular cross-section and an inner trapezoidal cross-section.

* * * * *